United States Patent [19]

Ebeling et al.

[11] Patent Number: 4,803,940

[45] Date of Patent: Feb. 14, 1989

[54] SHIP AND SHIP LOADING AND UNLOADING SYSTEM

[75] Inventors: Jaakko Ebeling; Jarmo Pesonen, both of Helsinki, Finland; Inge Sandaas, Grimstad, Norway

[73] Assignees: Ugland Trading Co. A/S, Grimstad, Norway; Jaakko Poyry Oy, Helsinki, Finland

[21] Appl. No.: 917,681

[22] Filed: Oct. 10, 1986

[51] Int. Cl.[4] ..... B63B 25/22; B63B 25/02; B63B 27/10; B63B 27/14

[52] U.S. Cl. ..... 114/72; 114/73; 114/75; 212/191; 414/141.8

[58] Field of Search ..... 114/72, 73, 75, 244; 414/139, 144; 212/190, 191

[56] References Cited

U.S. PATENT DOCUMENTS

| | | | |
|---|---|---|---|
| 652,243 | 6/1900 | Brown | 212/191 X |
| 2,976,823 | 3/1961 | Dodge | 114/75 X |
| 2,988,036 | 6/1961 | Mooneyhau et al. | 114/72 |
| 3,244,297 | 4/1966 | Kinkopf | 212/190 X |
| 4,002,135 | 1/1977 | Tornquist | 114/73 X |
| 4,138,961 | 2/1979 | Roper | 114/72 |

FOREIGN PATENT DOCUMENTS

| | | | |
|---|---|---|---|
| 60530 | 10/1981 | Finland . | |
| 113385 | 5/1968 | Norway | 114/72 |
| 125265 | 8/1972 | Norway . | |
| 1116592 | 6/1968 | United Kingdom | 114/72 |
| 1231486 | 5/1971 | United Kingdom | 114/244 |
| 1543002 | 3/1979 | United Kingdom . | |
| 1577744 | 10/1980 | United Kingdom . | |

*Primary Examiner*—Sherman D. Basinger

*Attorney, Agent, or Firm*—Cushman, Darby & Cushman

[57] ABSTRACT

The invention relates to a ship having at least one side port for loading and unloading. The main deck of the ship, which does not have any cargo hatches, supports a rectangular superstructure, the top ceiling of which supports a rail system for an overhead crane moving in the longitudinal direction of the ship, the side port being hinged at its lower end and forming a ramp which is connected to an intermediate cargo deck that moves up and down so that the ramp and the intermediate cargo deck can be aligned horizontally with the quay irrespective of the height of the quay, in which case the mixed cargo compiled into large uniform cargo units can be moved by a tractor-trailer into the ship for final positioning by the overhead crane. Alternatively, the side port is hinged at the top edge and its inner surface is provided with rails for the trolley of the overhead crane so that when the side port is raised to horizontal position, the rails in the side port form a rail extension, allowing the crane's trolley to be run out over the quay to pick up and finally position in the ship's hold the cargo units into which mixed cargo has been compiled and transported alongside the ship.

14 Claims, 7 Drawing Sheets

Fig. 5a
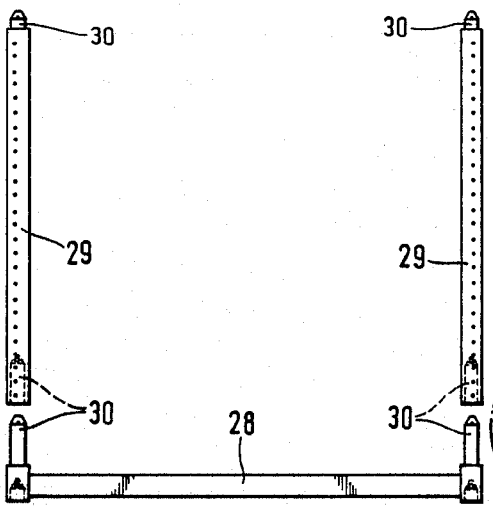
Fig. 5b
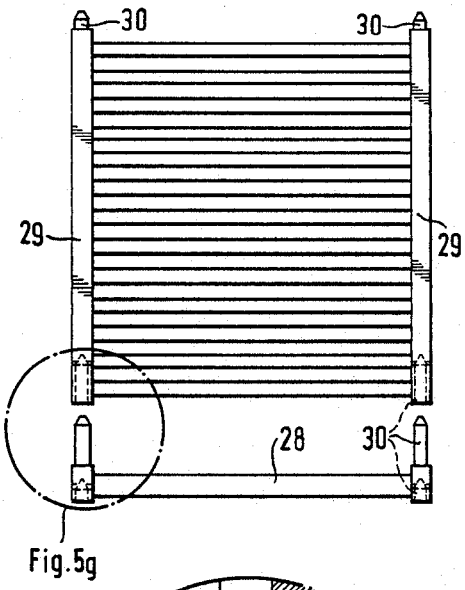
Fig. 5c
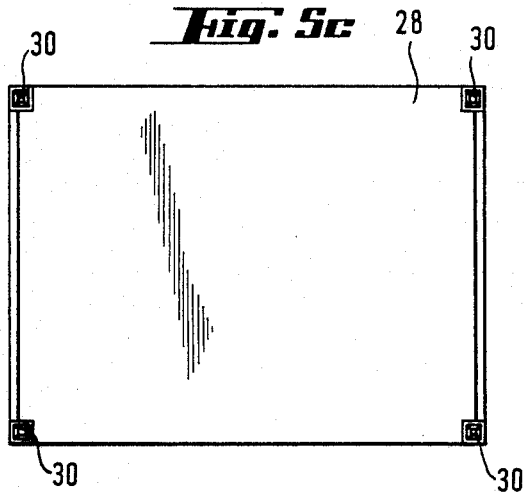
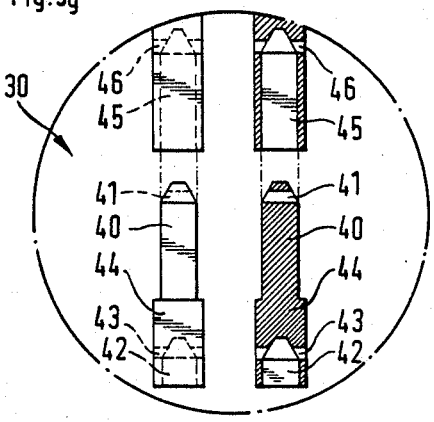
Fig. 5g

SHIP AND SHIP LOADING AND UNLOADING SYSTEM

BACKGROUND OF THE INVENTION

This invention relates to an ocean-going ship which is constructed so that it has no one side or on both at least one side port for loading and unloading, and to a system for loading and unloading this ship. The ship according to this invention is particularly suitable for transporting forest industry products, but it can also be used for transporting other mixed cargoes and bulk materials.

A typical transport chain for transporting mixed cargo consists of the following phases:

Storage at mill
Transport to harbour terminal
Storage and handling in harbour terminal
Loading the ship
Ocean transport
Unloading the ship
Storage and handling in the receiving terminal
Transport to customer The chain involves numerous handling stages. To keep total costs down, handling costs should be low and damage to the cargo minimized. One way to achieve this is to handle and transport the cargo in as big units as possible. In this way, the number of handling times is reduced and efficiency is improved. This is particularly important in the the harbour and during ocean transport, because a ship's transport capacity is decisively dependent on the time it spends in harbour, and the damage to the cargo is dependent on the number of handling times.

It follows from mathematical laws that the bigger the cargo space, the greater the filling degree achieved when loading it for example with miscellaneous forest industry products, such as pulp, paper rolls, sheeted fine paper, sawn timber. The unused space between cargo items is minimized.

The forest product industry's transport requirements often include imports of chemicals, salt, china clay, coal and wood chips. It is advantageous for the industry if the same degree of transport efficiency can be achieved with these bulk products, using the same transport equipment. This allows economical return cargo transport.

Because the strive towards greater efficiency particularly in harbours often leads to irregular working hours, it would be a major advantage if the desired efficiency were achieved inside a normal 8-hour working day.

There are several transport systems on the market for handling the above-mentioned transport requirements. They can be roughly divided into the following main groups:

1. The RoRo system (roll on/roll off), in which the cargo is moved on wheeled trailers into the ship, with the trailers following the cargo to the receiving harbour. The trailers can be used between the harbour terminals or in some cases for taking the cargo all the way to the customer. This system is particularly common for transporting paper. Its main advantage is the small number of handling times. Its main disadvantage is the large amount of stowing and lashing work in the loading terminal and the ship, which has to be done manually. The efficiency in loading and unloading the ship is satisfactory. Because of the large amount of work in the terminal and expensive special ship structures, this system is expensive. The use of space in the ship's cargo hold is very inefficient. This leads to large vessel size in relation to the cargo voume. In addition, the many tween decks in the ship have to be reinforced to withstand the handling and transport of heavy loads on small wheels. The systems is not suitable for transporting bulk cargoes and also requires specially designed harbour-based equipment (for example interface with vessels' ramps and other special structures) especially in tidal harbours. The standard units weigh 30 tons.

2. The Sto-Ro (Stowable RoRo). In this system the load is transported by trailer into the ship where the cargo is stowed using lift-trucks. The trailers do not follow the cargo. The loading efficiency in this system depends on the handling capacity of the lift-trucks. The top limit is determined by the maximum number of lift-trucks that can work with one trailer or in one stowing area. The main disadvantages of the system are the strick requirements for a homogeneous cargo, and the limited possibilities of improving loading and unloading efficiency. Bulk cargoes cannot be transported with this system. For technical reasons, the ship is expensive, with load units normally in the range of 1 to 4 tons. When using flats or containers the maximum unit size is up to 30 tons.

3. The side port system. In this system an elevator arrangement takes the cargo through a port in the side of the ship to the various decks. The cargo is handled by lift-trucks. The trailers do not follow the cargo into the ship. The system puts fairly small requirements for harbour facilities. The system is not suitable for transporting bulk cargoes. The system's loading and unloading capacity is limited (for the same reasons as in item 2 above). The units handled normally weigh from 1 to 4 tons.

4. The LoLo (lift on/lift off) system. The LoLo system is the oldest of all systems described here. In this system, the cargo is hoisted into its final place in the ship's hold by cranes. On-board cranes are either gantry cranes or revolving deck cranes. Gantry cranes have been used to hoist 30 to 40-ton loads (for example containers or wood pulp), but the possibilities of developing the system are limited by its poor suitability for handling mixed products such as paper rolls, paper pallets, sawn timber etc. in the same cargo. Following the growing degree of processing in the forest products industry, there is a clear trend towards mixed cargoes. In the LoLo method several cranes are typically used simultaneously. This leads to difficulties with unexpected heeling of the ship as unit sizes increase. Because of the heavy weight of the crane itself, bigger cranes sizes are not possible, except on the very largest ships. Low overhead cranes cannot be used because of the space needed for deck cargo. The LoLo system can be used for handling bulk cargoes, but it requires complicated and expensive shore-based loading and unloading systems.

Combinations of the above-mentioned systems are also used to some extent.

The object of the invention at hand is to get a ship which allows better economy in ocean transport of mixed cargoes by increasing the ship's annual transport capacity, which is achieved through a signiticant reduction in the time that the ship spends in harbour. Another object is to get a ship that allows transport of mixed cargoes and bulk cargoes in the same ship (return cargoes). A further object is to get a ship which makes use of existing harbour facilities for loading and unloading without any special shore-based structures.

The increase in transport capacity for mixed cargoes is based on the use of large transport units. In other words, one object of the invention is to create a cargo unit of more than 100 tons, compared with conventional unit sizes of 20 to 30 tons. A further object is to create a cargo unit that is constructed so that it allows bulk cargo to be transported in the same ship, while at the same time carrying the full number of empty cargo flats.

SUMMARY OF THE INVENTION

The invention provides a ship with at least one side port for loading and unloading in either or both of its sides, and on which the main deck, which does not have any cargo hatches, supports a rectangular superstructure, the top part or ceiling of which is equipped with a rail system for one or more overhead cranes moving in the longitudinal direction of the ship, and on which the side port or all side ports are designed either so, (A) that is a hinged at its lower end and constructed as a ramp, which is connected to a tween deck that moves up/down and is possibly divided into parts, or so that the ramp and the tween deck or a part of it can be aligned horizontally with the quay irrespective of the height of the quay, in which case the mixed cargo compiled into big uniform cargo units on a flat can be moved by a tractor-trailer into the ship for final positioning by means of an overhead crane, or so (B) that the side port is hinged at the top and its inner surface provided with rails for the trolley of the overhead crane so that the side port can be raised to horizontal position, in which case the rails in the side port form an extension of the overhead crane's rails, allowing the overhead crane's trolley to be run out over the quay to pick up and final position in the ship's hold the flats on which mixed cargo has been compiled into big uniform cargo units.

DESCRIPTION OF THE PREFERRED EMBODIMENTS

In the ship according to this invention, the cargo unit is a rectangular flat with upward and downward pointing lifting and guide attachments at each corner of the flat, which allow the ends of the unit, which are fitted with corresponding attachments at the top and bottom, to be fastened to the flat; the loading attachment of the overhead crane and the transfer trailer are fitted with corresponding lifting and guide attachments for automatic hoisting and release of the load unit, and the load units stacked on top of each other in the ship's hold can be fastened to each other by means of the said lifting and guide attachments.

In the ship according to this invention the side walls of the superstructure constitute a convenient extension of the ship's hold, so the superstructure runs over the entire length of the ship. As a result, the complete cargo space is covered and the cargo is not subject to damage by rain or by other weather problems that might disturb loading and unloading. The ship according to this invention and the loading and unloading system used in it can be implemented in any size, even to a small 2000 dwt coaster. The invention can be implemented both in new ships by designing them from the beginning in accordance with this invention and in old ships by making the necessary conversions. The invention is particularly suitable for old LoLo vessels, which are suffering from weak economy in spite of their good technical condition.

The economy of a ship according to this invention is not sensitive to variations in the stowage factor, i.e. the volumetric weight of the cargo does not affect unit transport costs in the same way as with competing systems (RoRo, LoLo, StoRo etc.). This is because of the superstructure on top of the ship's main deck, the height and volume of which are determined by the stability and other technical characteristics of each ship. In any case, the superstructure is big enough to allow a sufficient tonnage to be transported even with most low-density cargoes, such as paper and converted paper products. This fact is significant for the ocean transport costs of different categories of goods.

DESCRIPTION OF THE DRAWINGS

FIGS. 5*a–g* show the cargo unit used in the ship according to this invention, which consists of a flat and two ends, with FIGS. 5*a* and 5*b* showing the cargo unit from the side and the end, respectively, before assembly, FIG. 5*c* shows the cargo unit seen from the top, FIG. 5*d* shows the cargo unit from the end after assembly, FIG. 5*e* shows how in a typical case six flats have been combined into a unit, FIG. 5*f* shows this unit seen from the top, illustrating the location of the ends, and FIG. 5*g* shows at a larger scale the lifting and guide attachments used to assemble the ends and the flat into a cargo unit.

FIG. 6 shows at a larger scale the lifting and guide attachments of the transfer trailer used in conjunction with the lifting and guide attachments of the cargo unit.

DETAILED DESCRIPTION OF THE PREFERRED EMBODIMENTS

Figure 1:
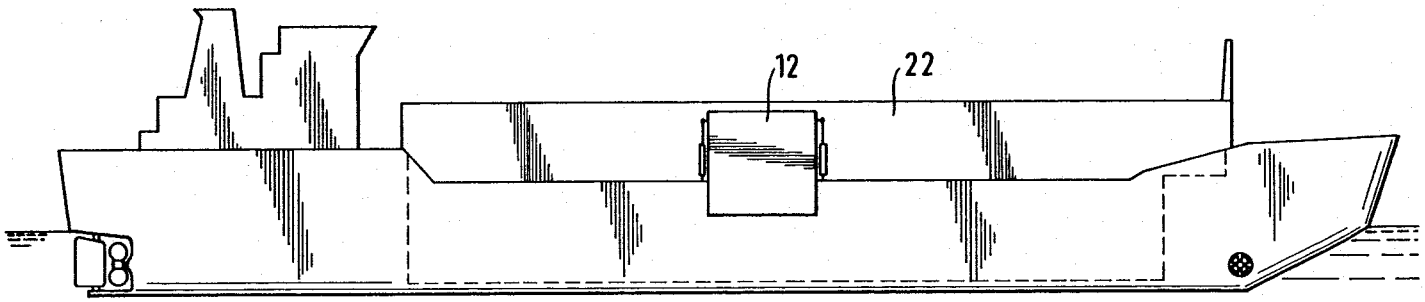
FIG. 1 shows a ship designed according to the first type of application (alternative A).
Figure 3B:
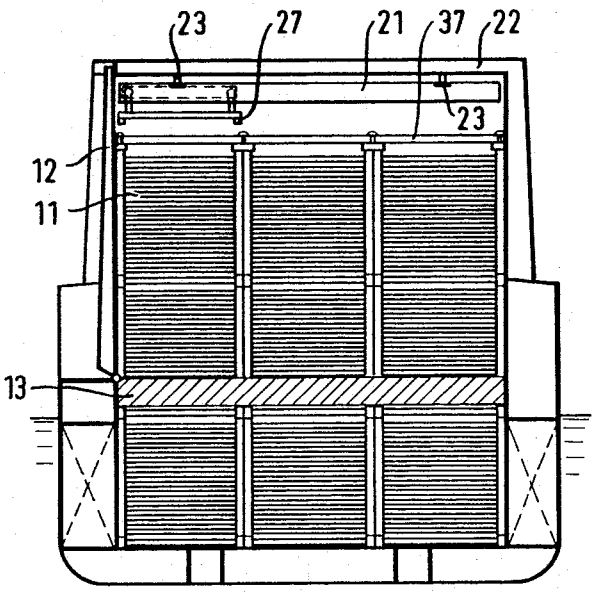
FIGS. 3*a* and 3*b* show a cross section at the point of the side port of a ship according to FIG. 1, with FIG. 3*a* showing the ship during loading and FIG. 3*b* when loading is completed.
Figure 3A:
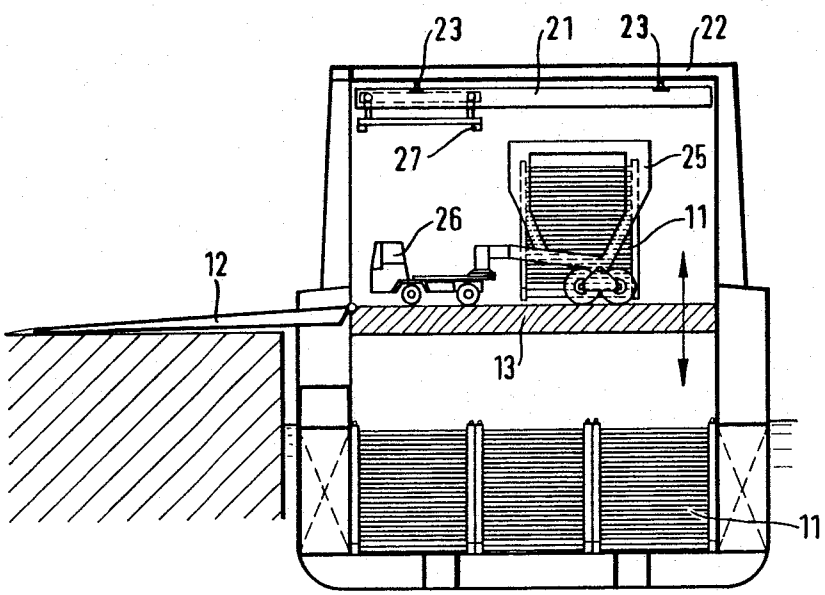

In the ship according to this invention as shown in FIGS. 1 and 3 the cargo hold under the main deck, which has no hatches, has been extended upwards by means of a superstructure 22 extending over the complete cargo space. The side walls of the superstructure 22 are an extension of the sides of the cargo hold or of the sides of the ship. The ceiling of the superstructure 2 is equipped with rails 23 for the overhead crane 21 to be used in handling the cargo (FIG. 3*a*). The walls of superstructure 22 are also provided with rails for the cargo lashing booms 37 (FIG. 3*b*). During loading and unloading these booms 37 are stored at the end of the superstructure.

In this application the side port or door acts as a ramp 12, which is hinged at its bottom end and connected to the tween deck 13 inside the ship, which is vertically adjustable depending on the loading condition and/or water height variations so that the ramp 12 leading into the ship remains basically level with the quay. This arrangement allows large cargo units 11 to be moved by transfer trailers 25 specifically designed for the system, which are pulled by terminal tractors 26 used in the harbour, whose normal maximum load is less than half of the load of the cargo unit used in this invention, because the cargo units can always be moved horizontally. The cargo unit 11 towed into the ship is then moved by overhead crane 21 into its final position, and when loading is finished, the cargo units are locked in place by means of the lashing booms 37 shown in FIG. 3*b*. In this way, no extra personnel, apart from the cane operators, is needed inside the ship, whereas in other ocean transport systems for mixed cargoes, the final work for fastening the cargo on board is generally done manually.

In the application presented here, transporting big cargo units 11 into the ship and moving them by overhead crane 21 into the cargo hold or vice versa does not cause heeling of the ship, which is so common in conventional cargo handling systems, which in conventional designs prevents any increase in crane load capacities.

Figure 2:
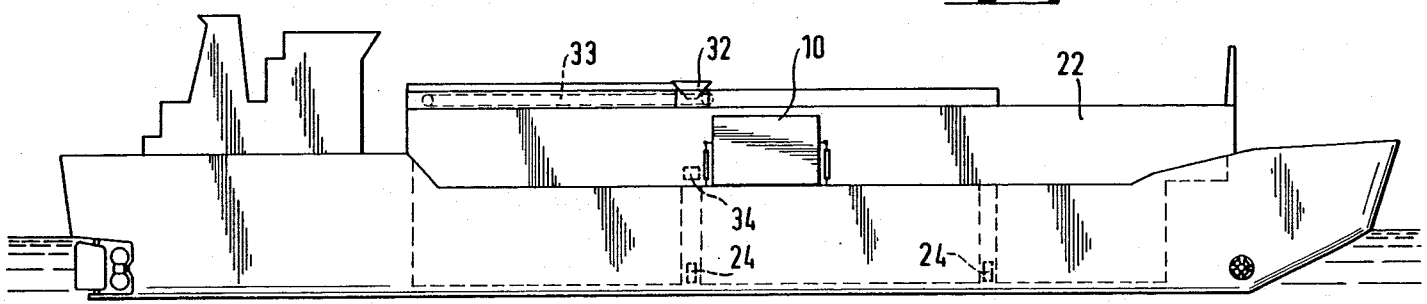
FIG. 2 shows a ship designed in the corresponding way according to the second type of application (alternative B).
Figure 4B:
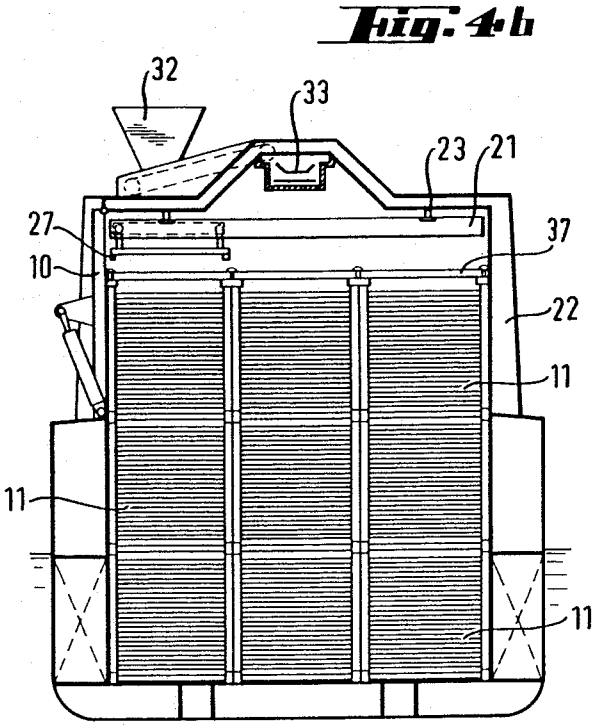
FIGS. 4*a* and 4*b* show, in the same way as FIGS. 3*a* and 3*b*, a ship according to FIG. 2, which is addition is equipped with a bulk material loading and unloading system.
Figure 4A:
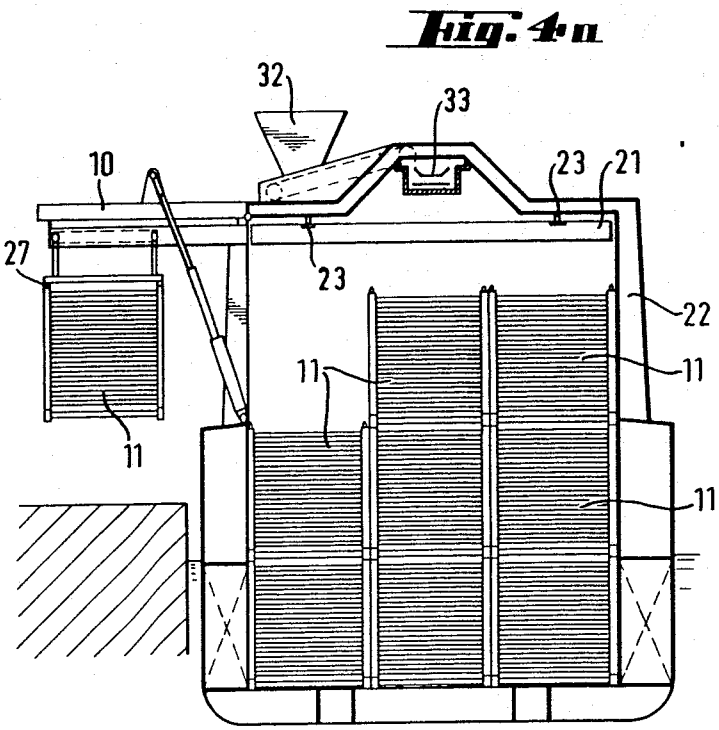

The application according to this invention shown in FIGS. 2 and 4 incorporates the same superstructure 22 as shown in FIG. 1, and the ceiling of the superstructure is also provided with rails 23 for the overhead crane 21. In this application the side port or door 10 has rails on the inside, which, when the side port is in open position as shown in FIG. 4*a*, are connected to the overhead crane 21 so as to allow the overhead crane trolley to be run out over the guay, thereby allowing the overhead crane to pick up the cargo unit 11 towed by tractor and transfer trailer alongside the ship and place it in its final stowing position. The cargo is secured in the same way as in the application shown in FIGS. 1 and 3.

Because the cargo unit in this application is hoisted from the quay, this may cause the ship to heel. According to this invention heeling of the ship is prevented by two independent methods.

One method is based on the fact that loading is done at only one point, so only one crane at a time will be in operation. This fact prevents unpredictable heeling caused by two or more cranes operating simultaneously.

Figure 7:
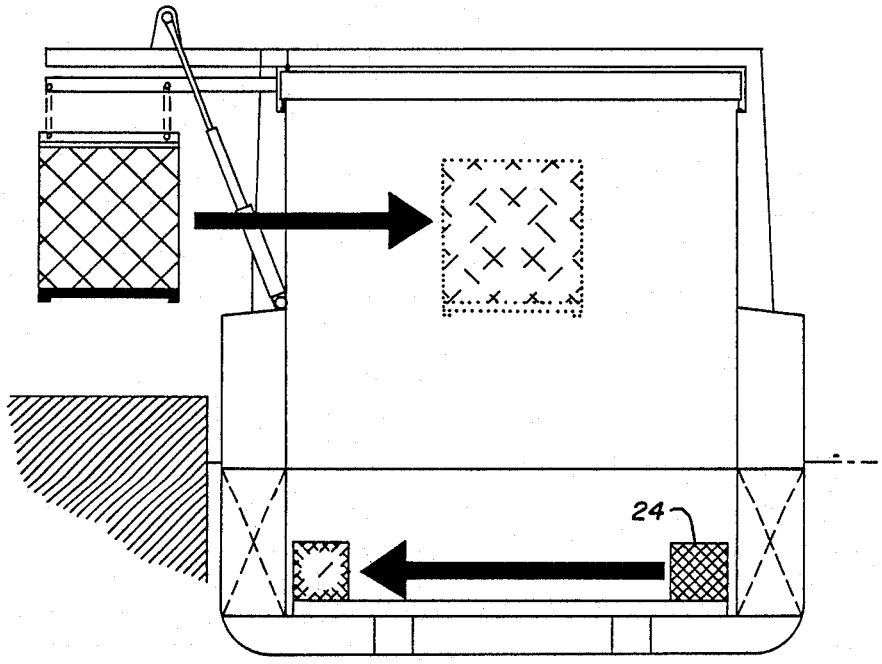
FIG. 7 is a cross-sectional view illustrating a counterweight system for preventing heeling of the ship during loading.

The other anti-heeling method is based on a counterweight system in the lower part of the cargo hold, which incorporates at least one counterweight 24 (FIGS. 2 and 7) movable across the width of the ship. The counterweights 24 are controlled by computer in relation to the movements of the overhead crane 21. The operation of the computercontrolled ballast system is possible only if loading is done from one point.

In spite of the fact that loading and unloading is done at only one point, there may be several overhead cranes in the applications shown in FIGS. 1 and 3 and FIGS. 2 and 4, respectively. High loading and unloading capacities can be achieved through controlled alternating use of these cranes.

FIGS. 2 and 4 also show a system for loading and unloading bulk cargoes. This system incorporates a conveyor 33 moving in longitudinal direction inside the superstructure 22. The conveyor 33 is connected by another conveyor shown by dotted lines to a feed hopper 32 fitted on top of the superstructure 22. The conveyor 33 is conveniently situated in an elevated part of the superstructure so that it runs along the centre line of the ship above the overhead crane 21. The bulk material is fed by a shore-based loader into the feed hopper 32, from which it flows onto conveyor 33 for transport to the bulk cargo space in the ship's hold. The bulk material is unloaded through a port in the cargo hold or through side port 10 by means of a conveyor 34 (FIG. 2.) that can be pulled out through an opening in the ship's side. No special quay or shore-based crane are needed for unloading bulk material. The bulk material can be unloaded direct into the feed hopper of the conveyor taking the material to the storage area. The ship can be moored to dolphins for unloading. The ship can also be anchored in the roadstead for unloading into barges.

Figure 5D:
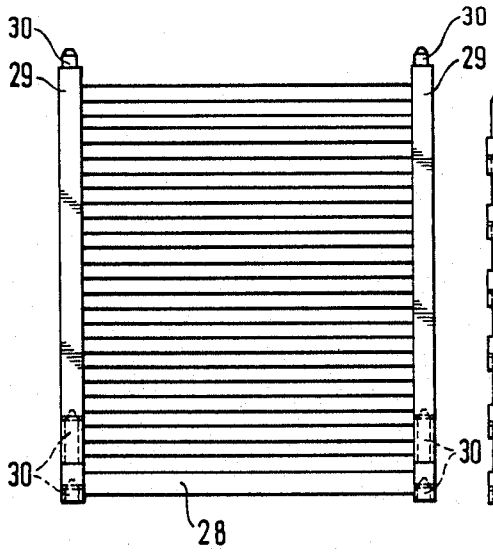

FIGS. 5*a–g* show the cargo unit used in the ship according to this invention. The cargo unit consists of a flat 28 and detachable ends 29 (FIGS. 5*a–c*). The dimensions of the flat can be for example about 6.0 m×5.0 m, and the ends 29 can be about 5.4 m high, so the total height of the assembled cargo unit (FIG. 5*d*) is about 5.7 m. A cargo unit of this kind can take four 20 fit standard containers in pairs beside and on top of each other. The dimensions given here are, however, only examples of the big cargo unit to be used in the ship according to this invention.

The flat 28 has lifting and guide attachments 30 at each corner, which are shown at a larger scale in FIG. 5*g*. These lifting and guide attachments consist of pins 40 directed upwards, the top end of which is conical with a crosswise drilled hole 41 for the fastening pin which is not shown in the figure. The lower part of the ends 29 is provided with a support recess 42 into which pins 40 fit smoothly. The recess also has a hole 43 for the fastening pin. In this way, ends 29 can be fastened to the flat 28 by lowering the recesses 42 onto the pins 40 and by pushing the fastening pins through holes 41 and 43. The assembled cargo unit is shown in FIG. 5*d*.

Figure 5E:
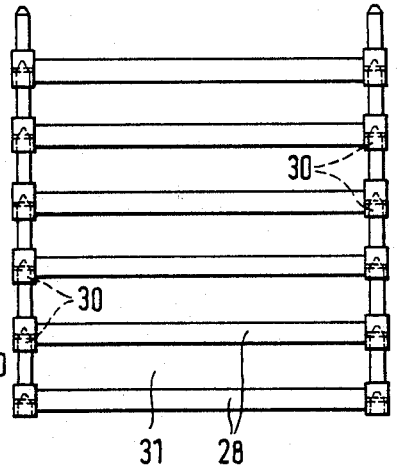
Figure 5F:
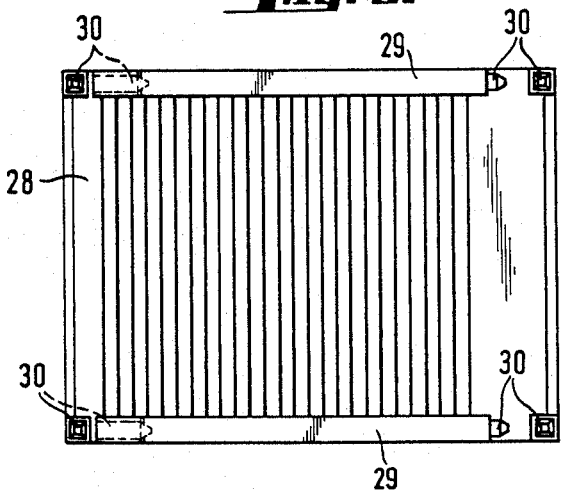
Figure 6B:
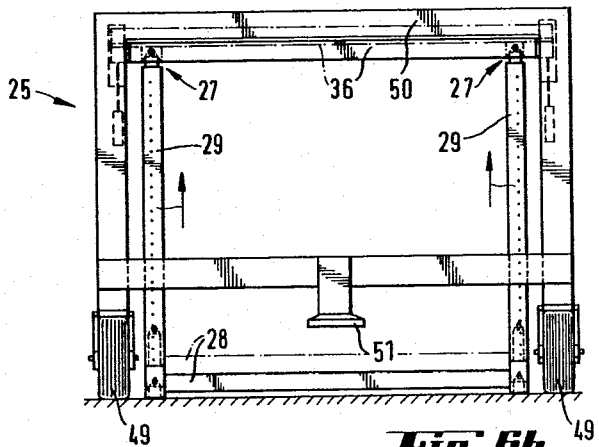
FIGS. 6*a–d* show the transfer trailer used to transfer the cargo unit according to FIG. 5, with FIGS. 5*a–c* showing the transfer trailer from the side, front and top.
Figure 6D:
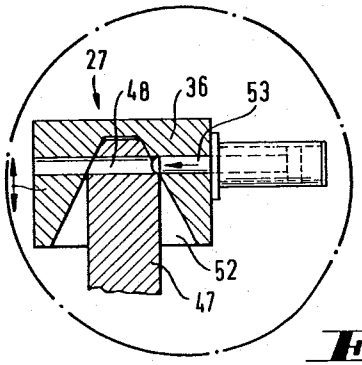
Figure 6A:
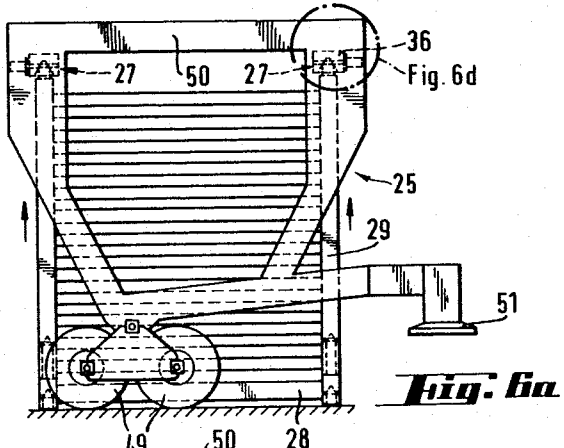
Figure 6C:
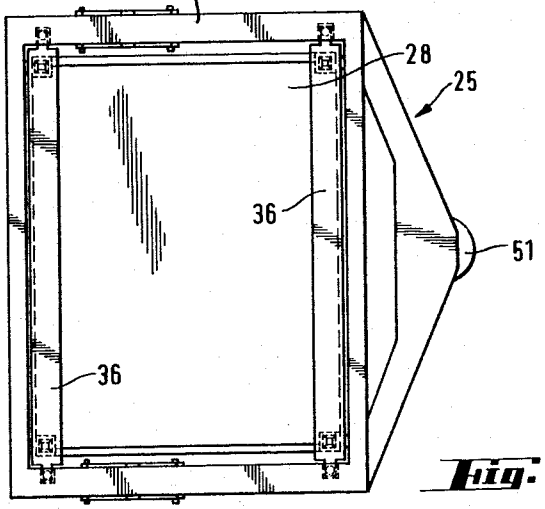

In addition, the base 44 of the pins 40 is provided with a recess 45 corresponding to the pin 40 and with a crosswise hole for the fastening pin. As a result the lifting and guide attachments in the flat 28 can also be used to stack several flats on top of each other as shown in FIG. 5*e*. In this case the pins 40 of the bottom flat are fitted into the support recesses 45 of the top flat and the fastening pins are pushed through drilled holes 41 and 46. In the example shown in the figure, six flats 28 have been combined into a unit 31, the size of which corresponds to the size of the cargo unit shown in FIG. 5*d*. In this case, ends 29 are attached to different flats 28 as shown in FIG. 5*f*. In this way the ship can take the full number of cargo units and still space is left in the hold for bulk materials to be transported as return cargo.

In addition to the lifting and guide attachments described in the foregoing the top ends of the ends 29 are equipped with lifting and guide attachments 30 for automatic loading and unloading of the cargo unit using the transfer trailer and the ship's overhead crane. These lifting and guide attachments consist of a conical pin 47, with a crosswise drilled hole 48 for a fastening pin. The transfer trailer used for moving the cargo unit is shown in FIGS. 6*a–d*. It consists of a chassis 50 on wheels 49, with a turntable 51 for attaching the transfer trailer 25 to the terminal tractor 26. The chassis 50 is sized so that the cargo unit fits into it crosswise. For unloading and loading the cargo unit 11 the chassis 50 is equipped with booms 36 which can be lowered and raised, and which are provided with fastening devices 27. These fastening devices, which are shown at a greater scale in FIG. *6d*, consist of recesses 52 in the lower end of the lifting booms, into which the pins 47 in the top end of the cargo unit's ends are guided, allowing a fastening pin 53 to penetrate through the lifting boom. The fastening pin is hydraulically or pneumatically operated from the tractor 26 so that when the lifting booms 36 have been lowered over the pins 47 in the cargo units ends, the fastening pins 52 can be pushed into the hole 48 of the pins 47, fastening the cargo unit to the lifting booms 36 and allowing it to be hoisted and transported either into the ship (alternative A) or alongside the ship (alternative B). To unload the cargo unit, it is lowered by the lifting booms 36, after which fastening pins 52 are removed from the recesses 48. Because the cargo unit is crosswise in the tranfer trailer 25, it will be positioned longitudinally when taken into the ship, allowing it to be taken longitudinally by the ships overhead crane 21 to its final position.

The loading devices of the ship's overhead crane consist—in the same way as the loading devices of the transfer trailer 25—of lifting booms, which are equipped with the same kind of fastening devices 27 as the lifting boom 36 of the transfer trailer, with the fastening devices being controlled from the cabin of the overhead crane 21.

The cargo units to be loaded into the ship are preloaded inside the harbour terminal, including lashing of the cargo, before the ship arrives. The cargo units are moved into the ship or alongside this ship using the transfer trailer 25 as described in the foregoing. When unloading the ship, the operations occur in reverse order, after which the empty cargo units are combined into units as shown in FIG. *5e* and loaded back into the ship.

Of course, the applications described in the foregoing are only examples of how the invention can be used and the applications can be varied in many ways within the basic design of the invention.

What is claimed is:

1. A ship having opposite sides between which there is a cargo space extending longitudinally of the ship along a substantial portion of the length of the ship; a superstructure supported by the ship, said superstructure having a ceiling located above and extending over the cargo space, a rail system supported from the ceiling and extending longitudinally over the cargo hold; a crane movable longitudinally over the cargo hold and longitudinally along the rail system; an intermediate cargo deck mounted in the cargo space for vertical movement relative to the sides of the ship; at least one cargo opening in at least one side of the ship through which cargo may be moved by a transfer container; a door residing in said opening, the door having a lower edge pivoted to the intermediate cargo deck, the arrangement of the door and vertically movable intermediate cargo deck being such that the door can swing away from the side of the ship to function as a loading ramp which can be positioned generally horizontally and at the level of the upper surface of a guay, within limits, irrespective of the height of the guay above water level thereby allowing mixed cargoes assembled into cargo units to be taken by a transfer trailer through said opening and into the cargo space for final positioning by said crane.

2. A cargo unit to be used in the ship described in claim 1 comprising a rectangular flat, which at each corner is provided with up and downward pointing lifting and guide attachments, with the aid of which the ends of the flat, which in their top and bottom corners are fitted with corresponding lifting and guide attachments, can be attached to the flat, in addition to which the loading attachment of the ship's overhead crane and the loading attachment of the cargo unit transfer trailer are equipped with the same type of lifting and guide attachments for automatic hoisting and release of the cargo unit.

3. A cargo unit according to claim 2, which is sized to hold four standard containers in pairs side by side and top of each other.

4. A cargo unit according to claims 2 in which several flats can be attached by means of lifting and guide attachments on top of each other into units, which do not require more space than one single cargo unit fitted with ends, in such a manner that the ends are stacked horizontally on top of the flats.

5. A ship as in claim 1 wherein said superstructure has side walls forming a continuation of the walls of said cargo space and wherein said superstructure extends over the entire longitudinal dimension of said cargo space.

6. A ship as in claim 1 including a bulk material conveyor system located inside said superstructure for transporting bulk material to various parts of the cargo space, a receiving hopper for discharging bulk material to the conveyor system, and a separate conveyor for unloading bulk material from said conveyor system, said separate conveyor extending through an opening in the ship, which opening may be said cargo opening.

7. A ship as in claim 6 wherein said conveyor system is located above said crane.

8. A ship as in claim 1 in which the side walls of the cargo space are provided with rails for lashing booms moving lengthwise in the cargo space and which are used for lashing cargo units in place in the cargo space.

9. A ship having opposite sides between which there is a cargo space extending longitudinally of the ship along a substantial portion of the length of the ship; a superstructure supported by the ship, said superstructure having a ceiling located above and extending over the cargo space, a rail system supported from the ceiling and extending longitudinally over the cargo hold; a crane movable longitudinally along the rail system, said crane including a trolley which is movable transversely of the cargo space; at least one opening in at least one side of the ship through which cargo may be moved; a door residing in said opening, the door having an upper edge pivoted to the side of the ship so as to swing outwardly away from said side to a horizontal position, said door having an inner surface provided with rails which in the horizontal position of said door, can receive the trolley so that the latter can be run out over a guay to hoist mixed cargo assembled into cargo units and to then transport the cargo through said opening and into said cargo space.

10. A ship as in claim 9 wherein said superstructure has side walls forming a continuation of the walls of said cargo space and wherein said superstructure extends over the entire longitudinal dimension of said cargo space.

11. A ship as in claim 9 including an anti-heeling system in the lower part of the cargo space to prevent heeling of the ship caused by lifting and lowering of cargo units, said anti-heeling system comprising at least one counterweight automatically movable athwartship in relation to the movements of said crane.

12. A ship as in claim 9 including a bulk material conveyor system located inside said superstructure for transporting bulk material to various parts of the cargo space, a receiving hopper for discharging bulk material to the conveyor system, and a separate conveyor for unloading bulk material from said conveyor system, said separate conveyor extending through an opening in the ship, which opening may be said cargo opening.

13. A ship as in claim 12 wherein said conveyor system is located above said crane.

14. A ship as in claim 9 in which the side walls of the cargo space are provided with rails for lashing booms moving lengthwise in the cargo space and which are used for lashing cargo units in place in the cargo space.

* * * * *